US005690516A

United States Patent [19]

Fillinger

[11] Patent Number: 5,690,516

[45] Date of Patent: Nov. 25, 1997

[54] TRANSFORMER STUD ELECTRICAL CONNECTER

[75] Inventor: David R. Fillinger, Cincinnati, Ohio

[73] Assignee: Erico International Corporation, Solon, Ohio

[21] Appl. No.: 502,830

[22] Filed: Jul. 14, 1995

[51] Int. Cl.[6] ..... H01R 11/09

[52] U.S. Cl. ..... 439/798; 439/921; 439/814

[58] Field of Search ..... 439/798, 796, 439/797, 814, 921

[56] References Cited

U.S. PATENT DOCUMENTS

| | | | |
|---|---|---|---|
| 195,623 | 7/1877 | Leonardo | D26/1 |
| 302,420 | 7/1884 | McGrane | D13/24 |
| 306,716 | 3/1884 | Shimirak | D13/24 |
| 309,664 | 7/1884 | McGrane | D13/146 |
| 317,434 | 6/1885 | McGrane | D13/133 |
| 317,435 | 6/1885 | McGrane | D13/133 |
| 320,381 | 10/1885 | McGrane | D13/147 |
| 2,431,999 | 12/1947 | Engelhardt | 439/718 |
| 2,764,749 | 9/1956 | Aberle | 439/558 |
| 3,133,779 | 5/1964 | Stanback | 439/798 |
| 3,382,478 | 5/1968 | Satterthwait | 439/712 |
| 3,652,977 | 3/1972 | Feldberg | 439/724 |
| 3,874,760 | 4/1975 | Guthmiller et al. | 439/588 |
| 4,214,806 | 7/1980 | Kraft | 439/620 |
| 4,382,651 | 5/1983 | Klosen et al. | 439/359 |
| 4,513,169 | 4/1985 | McGrane | 174/138 F |
| 4,547,627 | 10/1985 | McGrane | 174/138 F |
| 4,785,378 | 11/1988 | Hinckley et al. | 361/652 |
| 5,201,678 | 4/1993 | Venezia | 439/723 |

FOREIGN PATENT DOCUMENTS

| | | |
|---|---|---|
| 1229880 | 9/1960 | France . |
| 2085672 | 4/1982 | United Kingdom . |

OTHER PUBLICATIONS

Homac Mfg. Company, "A Totally New Concept In Safety & Reliability, Homac's Zeebar Disconnectable Secondary Transformer Connector", UD-19.

Homac Mfg. Company, Homac's Zeebar Compact! Easy to Install, Oct. 1987.

Electrical System Distributor, Sep. 1988, p. 50.

Connector Manufacturing Co. Brochure, revd. Oct. 20, 1986, pp. 7–8 Dual Rated Solderless Lugs.

ILSCO Pocket Guide, Revised Edition, 1985, pp. 3–6.

*Primary Examiner*—Neil Abrams
*Assistant Examiner*—T. C. Patel
*Attorney, Agent, or Firm*—Renner, Otto, Boisselle, Sklar

[57] ABSTRACT

A slip-fit electrical connector for a threaded transformer stud has a stepped or key type stud hole which includes an oversize unthreaded circular hole on top and a slightly smaller intersecting hole on the bottom. The bottom hole has threads matching those of the stud and a jam screw forces the threaded stud into intimate contact with the threads of the smaller hole, such contact extending over a substantial arc. The connection provides a tight and improved electrical connection having simplicity of installation.

9 Claims, 1 Drawing Sheet

TRANSFORMER STUD ELECTRICAL CONNECTER

DISCLOSURE

This invention relates generally as indicated to a transformer stud electrical connector, and more particularly, a connector which combines the advantages of both the screw-on and slip-fit type.

BACKGROUND OF THE INVENTION

In power distribution, transformers are provided with extending threaded studs which are usually copper. Stud connectors are secured to such studs and a number of conductors are in turn secured to the connectors. Typically, the stud connector has an elongated body of conductive material such as aluminum with a stud receiving hole in one end and a plurality of transverse holes or ports in which the conductors are clamped by set screws, for example. The bottoms of the holes or ports form pads against which the conductors are clamped by the set screws.

For many years transformer stud connectors have been supplied in two styles: the slip-fit (UPM series) and the screw-on (UPSO series). The UPM and UPSO connectors are a series of underground extruded connectors sold by ERITECH, Inc. of Aberdeen, N.C.

The screw-on version has an internal thread in the connector matching the thread on the transformer stud and is installed by rotating the connector onto the threaded stud. Since the stud is of considerable length, a large number of revolutions of the connector is required to seat and lock the connector on the stud. Moreover, the exact position of the connector on the stud usually requires the tightening of a lock nut against the connector.

The slip-fit has an oversized hole compared to the stud diameter. ANSI standards threads for transformer studs are ⅝"–11 and 1"–14. The connector is installed by sliding the oversized connector over the threaded stud and tightening a jam screw from the top side of the connector to force the internal and external threads to mesh. The contact area is less than a perfect fit since the diameters do not match and the threads between the stud and connector do not completely seat. Moreover, the contact between the stud and the connector occurs only along a very narrow strip along the bottom of the stud. Also, as a result of the limited interface, the connector has a tendency to pivot when pressure is applied to the outer end of the connector, especially when additional conductors are installed. This has a potential to loosen the connection and cause a failure. This potential has been cause for concern at many utilities over many years.

It would, accordingly, be desirable to have a connector which combines the tight fit of the screw-on connection with the easier and quicker installation of the slip-fit connector, while at the same time providing a much improved electrical connection.

SUMMARY OF THE INVENTION

The stud connector of the present invention has a stud hole which includes two centers forming intersecting hole portions. The stepped or key type stud hole in the connector has an oversize unthreaded hole portion on top and a slightly smaller intersecting hole portion on the bottom. The bottom hole portion extends symmetrically about a vertical axis and almost 180 degrees from its one point of intersection with the larger unthreaded hole portion to the other. The smaller hole portion is provided with internal threads exactly matching the external threads of the stud. One or more jam screws above the hole are tightened on the stud after the connector has been slipped over the stud. This forces the stud into the almost half round threaded seat of the smaller hole portion and locks the connector against movement, even when considerable force is applied to the connector as when a set screw is torqued on one of the outer conductor ports. The contact area is over three times that of a standard slip-fit connector providing a much improved electrical connection.

The invention provides an ease of installation, while providing a tight connection eliminating pivoting. It also provides a significantly improved electrical connection with considerably increased contact area between the matched threads over a much larger pressure arc. The connection also reduces transformer change out time. More importantly, it eliminates the potential to loosen and cause a failure.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
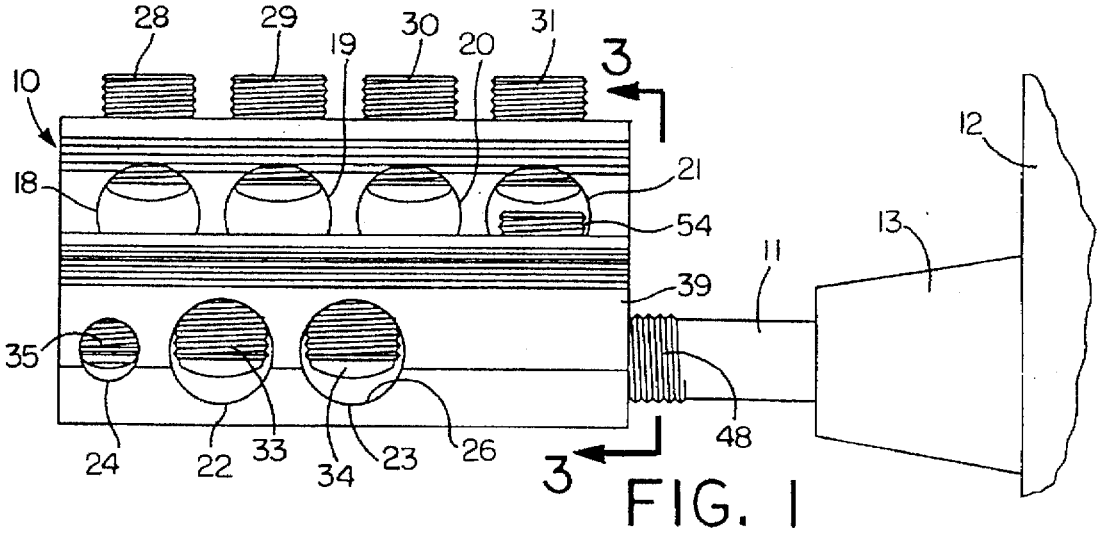
FIG. 1 is an elevation showing the transformer broken away, the transformer stud, and one form of connector secured thereto.
Figure 2:
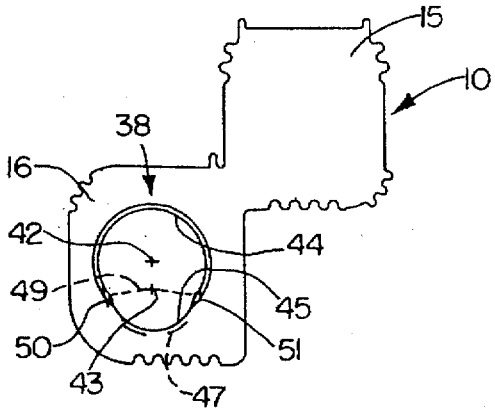
FIG. 2 is an end elevation of the connector showing the two-center stud keyhole.
Figure 3:
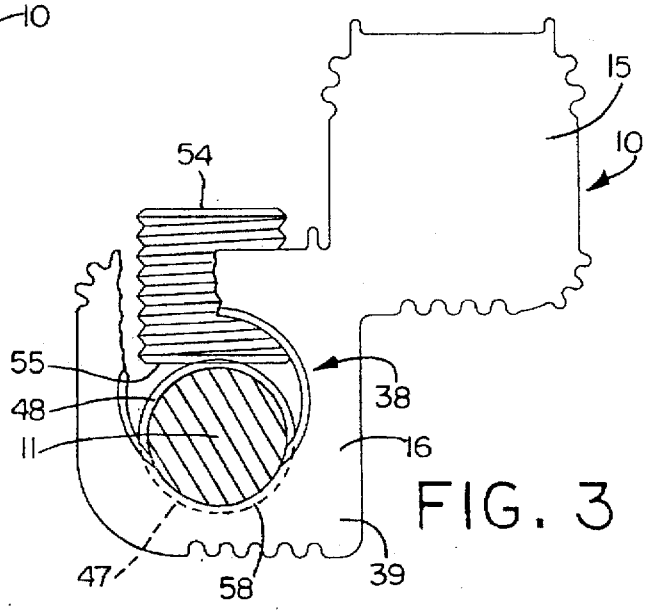
FIG. 3 is an enlarged fragmentary section taken from the line 3—3 of FIG. 1 showing the contact area between the stud and connector.

Referring initially to FIGS. 1–3 there is illustrated one form of connector shown generally at 10 which is secured to transformer stud 11 extending from transformer 12 through bushing 13.

The connector 10 is somewhat elongated on the axis of the stud and includes offset body portions 15 and 16. The upper body portion includes four conductor ports seen at 18, 19, 20 and 21, while the lower body portion includes conductor ports 22 and 23, as well as somewhat smaller conductor port 24. Each conductor port is provided with a wire-binding set screw extending normal to the port which clamps or binds the wire or conductor against the opposite side of the port or hole which forms a cylindrical pad on the connector against which the wire or conductor is clamped. The pad, for example, is shown at 26 in FIG. 1. The four set screws for the upper ports 18–21 are shown are shown at 28, 29, 30 and 31 in the retracted position, while the set screws 33 and 34 for the holes 22 and 23, respectively, are shown extended or screwed in. The same is true for the somewhat smaller set screw 35 for the hole 24.

The holes in the bottom portion of the connector are offset to the left as seen in FIG. 1 to allow room for the formation of the blind stud hole shown generally at 38 in the right-hand end 39 of the connector.

As seen more clearly in FIG. 2, the blind stud hole 38 includes two centers 42 and 43 which are used to form the intersecting larger hole portion 44 and the smaller hole portion 45. The two centers are vertically aligned yet spaced to form the symmetrical keyhole configuration illustrated.

The oversized larger hole portion 44 is unthreaded while the smaller hole portion 45 is provided with threads 47 matching the external threads 48 of the stud.

The spacing of the centers 42 and 43 is such that the obtuse angle illustrated by the dotted line 49 in FIG. 2 is almost 180 degrees. Such angle is measured between the symmetrical intersections 50 and 51 of the two hole portions at the center 43 of the smaller hole portion 45.

The larger hole portion 44 is substantially larger than the stud 11 so that the connector may readily be simply slipped on to the stud and secured in place by tightening jam screw 54. The jam screw is provided with a flat bottom 55 and a recessed hex head so that it may be readily tightened on the stud forcing the stud into intimate contact with the threads 47 over the almost semicircular contact area 58. The set screws likewise will be provided with recessed hex heads.

Once the jam screw 54 is tightened onto the stud as seen in FIG. 3, the connector 10 is locked to the stud and cannot rotate around the axis of the stud or around any axis of the stud hole. The smaller hole portion, in effect, forms a key way into which the transformer stud snugly and intimately fits.

For larger size connectors, more than one jam screw may be provided. Also, although not readily apparent in the drawing, all holes may be countersunk to provide an interior chamfer around the hole edges and all corners of the connector may also be chamfered.

Figure 5:
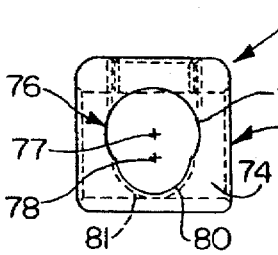
FIG. 5 is a right hand end elevation of the connector of FIG. 4 showing the two-center hole.
Figure 4:
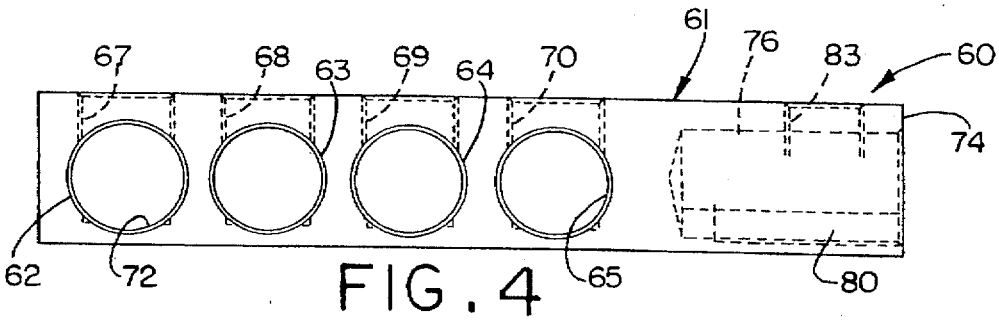
FIG. 4 is a front elevation of another form of connector using the two-center stud keyhole.

In FIGS. 4 and 5 there is illustrated another type of connector shown generally at 60. The connector may include an extruded aluminum body 61 which has four circular through holes 62, 63, 64 and 65 which extend through the body, front to rear, and each hole intersects with a tapped set screw hole as seen at 67, 68, 69 and 70, respectively, which extend from the top of the body. Wire binding set screws in such holes function to clamp conductors against the arcuate pad such as seen at 72 formed by the opposite side of the hole.

The end of the body indicated at 74 is provided with the keyhole blind hole shown generally at 76. The hole may be the same configuration as shown in FIG. 2 and includes the two centers 77 and 78 vertically aligned which form hole portions 79 and 80, respectively. The larger hole portion is unthreaded while the smaller bottom hole portion 80 is provided with internal threads matching the external threads of the transformer stud. These threads are shown at 81 in FIG. 5.

A threaded hole extends from the keyhole 76 to the top of the body as seen at 83 in FIG. 4 accommodating the jam screw. When the jam screw is tightened the stud is forced into intimate contact with the smaller hole threaded portion.

The contact area is almost 180 degrees and within a substantial arc of from about 135 to about 175 degrees about the center of the transformer stud.

It will be appreciated that some connectors may have the stud hole on the opposite end of the body and would appear as a substantial mirror image of those connectors illustrated.

It can now be seen that the present invention provides an ease of installation, while at the same time providing a tight connection eliminating pivoting. Most importantly, it eliminates the potential to loosen and cause a failure. The invention also provides a significantly improved electrical connection with considerably increased contact area between the matched threads over a much larger pressure arc. The connection also reduces transformer change out time.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A slip-fit transformer stud connector comprising an elongated body of conductive material, a plurality of conductor wire pads extending transversely of said body, means operative to clamp conductors to said pads, a stud hole in the end of said body operative to receive said transformer stud in a slip-fit, said hole being formed with two vertically spaced centers forming two-hole portions, the hole portion on the top center being a larger diameter than the hole portion on the bottom center with the hole portion on the bottom center intersecting the hole portion on the top center, the bottom hole portion being the same diameter as said stud, jam screw means above said stud hole operative to force the transformer stud against the hole portion on the bottom center locking the connector against rotation on the stud and providing a low resistance electrical connection between the stud and body, said transformer stud being threaded, and said somewhat smaller bottom portion including matching threads.

2. A connector as set forth in claim 1 wherein said pads are formed by wire ports, and set screw means to clamp conductors therein.

3. A connector as set forth in claim 1 wherein said jam screw forces the matching threads into intimate contact over a substantial arc.

4. A connector as set forth in claim 3 wherein said substantial arc is from about 135 to about 175 degrees.

5. A slip-fit transformer stud connector comprising an elongated body of conductive material, a plurality of conductor wire pads extending transversely of said body, means operative to clamp conductors to said pads, a stud hole in the end of said body operative to receive a transformer stud in a slip-fit, said stud hole having the transverse shape of a keyhole and having a somewhat smaller bottom portion, jam screw means to force the stud into the somewhat smaller bottom portion to lock the connector against rotation about the axis of the stud, said transformer stud being threaded and said somewhat smaller bottom portion including matching threads.

6. A transformer stud connector as set forth in claim 5 wherein said stud hole includes a larger circular unthreaded portion and a circular smaller bottom portion intersecting the larger portion.

7. A connector as set forth in claim 5 wherein said jam screw forces the matching threads into intimate contact over a substantial arc.

8. A connector as set forth in claim 5 wherein said pads are formed by wire ports, and set screws extending into said ports to clamp conductors therein.

9. A connector as set forth in claim 5 wherein said substantial arc is from about 135 to about 175 degrees.

* * * * *